US007521163B2

(12) United States Patent
Uemura et al.

(10) Patent No.: US 7,521,163 B2
(45) Date of Patent: Apr. 21, 2009

(54) RESIN-COATED FERRITE CARRIER FOR ELECTROPHOTOGRAPHIC DEVELOPER, ITS PRODUCTION METHOD, AND ELECTROPHOTOGRAPHIC DEVELOPER USING THE RESIN-COATED FERRITE CARRIER

(75) Inventors: Tetsuya Uemura, Kashiwa (JP); Toshio Honjo, Kashiwa (JP); Kanao Kayamoto, Kashiwa (JP)

(73) Assignee: Powdertech Co., Ltd., Chiba (JP)

( * ) Notice: Subject to any disclaimer, the term of this patent is extended or adjusted under 35 U.S.C. 154(b) by 388 days.

(21) Appl. No.: 11/272,024

(22) Filed: Nov. 14, 2005

(65) Prior Publication Data

US 2006/0121385 A1 Jun. 8, 2006

(30) Foreign Application Priority Data

Nov. 11, 2004 (JP) ..... 2004-327385

(51) Int. Cl.
*G03G 9/113* (2006.01)

(52) U.S. Cl. ..... 430/111.32; 430/137.13

(58) Field of Classification Search ..... 430/111.32, 430/137.13
See application file for complete search history.

(56) References Cited

U.S. PATENT DOCUMENTS 7,226,713 B2 * 6/2007 Yamashita et al. ..... 430/111.33
2004/0175643 A1 * 9/2004 Baba et al. ..... 430/109.4

FOREIGN PATENT DOCUMENTS

JP 359232362 * 12/1984

OTHER PUBLICATIONS

Abstract of JP359232362A Dec. 1984.*

* cited by examiner

*Primary Examiner*—Hoa V Le
(74) *Attorney, Agent, or Firm*—Rothwell, Figg, Ernst & Manbeck

(57) ABSTRACT

A resin-coated ferrite carrier having a uniform resin coating and emitting no offensive odors, etc., its production method, and an electrophotographic developer which comprises the resin-coated ferrite carrier, is excellent in the charge stability and image quality stability over a long period, causes less fogging of image or carrier adhesion, is favorable in the image density and environmental dependency, and can fully respond to high-speed and full-color imaging, are provided. The resin-coated ferrite carrier for the electrophotographic developer is characterized in that the surface of ferrite particles is coated with a mixed resin of a tetrafluoroethylene-hexafluoropropylene copolymer or a tetrafluoroethylene-perfluoroalkylvinyl ether copolymer and a polyamideimide resin, and that the mixed resin contains a silicon oxide.

5 Claims, No Drawings

RESIN-COATED FERRITE CARRIER FOR ELECTROPHOTOGRAPHIC DEVELOPER, ITS PRODUCTION METHOD, AND ELECTROPHOTOGRAPHIC DEVELOPER USING THE RESIN-COATED FERRITE CARRIER

BACKGROUND OF THE INVENTION

1. Field of the Invention

The present invention relates to a resin-coated ferrite carrier for a two-component electrophotographic developer used for copying machines, printers and the like, its production method, and an electrophotographic developer using the ferrite carrier, and relates in detail to a resin-coated ferrite carrier which is uniform and does not have problems of offensive odors and the like, its production method, and an electrophotographic developer which uses the ferrite carrier, has favorable characteristics in a long period, and can fully respond to the high-speed and full-color.

2. Description of the Related Art

The two-component developer used in electrophotography is constituted of a toner and a carrier; the carrier is mixed and agitated with the toner in a developer box; the toner is given a desired charge; and the charged toner is carried to an electrostatic latent image on a photoreceptor whereby the developer is a carrier material to form a toner image. The carrier is, after having formed the toner image, held by a magnet and stays on a development roll, further returned to the developer box, again mixed and agitated with new toner particles, and repeatedly used in a certain period.

The two-component developer, different from a one-component developer, is one in which the carrier agitates the toner particles, imparts a desired chargeability, and has a function of transporting the toner, has good controllability in developer design, and is therefore widely used in the fields of full-color machines requiring high-quality images and high-speed machines requiring reliability and durability of image sustainability.

In such a two-component electrophotographic developer, an iron-based carrier such as an oxide-coated iron powder and a resin-coated iron powder has been used. Patent Document 1 (Japanese Patent Laid-Open No. 6-19214) describes a carrier for full-color copying machines in which a mixture of an iron powder and a spherical ferrite particles is used as the carrier core material, and the coating resin is composed of two layers with the under coating material of a tetrafluoroethylenic resin containing a polyamideimide resin and the surface coating material of a tetrafluoroethylene-perfluoroalkylvinyl ether copolymer resin.

Since the iron-based carrier as described in Patent Document 1 has a large true specific gravity of one particle and then imparts a large stress on a developing machine, the life-elongation is difficult. Further, the resin-coated carrier composed of two layers raises a problem of layer exfoliation.

Then, ferrite carriers such as Cu—Zn ferrite and Ni—Zn ferrite, which have a lower true specific gravity than the iron-based carrier, are used. These ferrite carriers also have many characteristics advantageous over the conventional iron powder-based carrier in obtaining high-quality images.

As these ferrite carriers, spherical ones are commonly used. However, since the spherical ferrites alone are inferior in the resistance against toner spent, they cannot respond to resent year's higher durability.

Therefore, resin-coated ferrite carriers are used which have the carrier core material of ferrite particles surface-coated with a resin. As the coating resin used here, a silicone resin, a fluorinated epoxy resin and the like are used.

However, resin-coated ferrite carriers coated with a silicone resin have raised problems of fogging in copy images and carrier adhesion due to the change in charge quantity which is caused by internal temperature rise in continuous printing. On the other hand, the resin-coated carriers coated with a fluorinated epoxy resin have raised problems of toner scattering and fogging in copy images due to a decreased charge of the toner spent by continuous printing, and have also shown a faster loss of charge over time, thus inferior in durability. Further, in the case of using the fluorinated epoxy resin, the solvent needs to include an organic solvent with a strong odor such as methyl isobutyl ketone, and this case has problems of offensive odors and the like on production.

Hence, use of a fluororesin as the coating resin is proposed. Patent Document 2 (Japanese Patent Laid-Open No. 55-67754) describes a developer using a carrier whose core is covered with a resinous coating composed of a polytetrafluoroethylene of 5 to 55%, a fluorinated polyethylenepropylene of 5 to 55% and a poly(amide-imide).

However, the carrier core material used in Patent Document 2 is carrier beads, not ferrite particles. Besides, the coating resin used in Patent Document 2 includes a polytetrafluoroethylene, and when the coating resin including a polytetrafluoroethylene is coated on a carrier core material, the coating resin becomes clayey, and does not provide a good coating. Thus, developers using such resin-coated carriers are inferior in various properties.

Patent Document 3 (Japanese Patent Laid-Open No. 54-126040) describes a carrier material for an electrophotographic developer in which a skin layer composed of a material including a fluoropolymer is provided on the surface of a carrier core material via an intermediate layer including a resin which has a lower melting point and a larger dielectric constant than the fluoropolymer. Then, a polyamide resin and an ethylene-vinylacetate resin are exemplified as the intermediate layer.

However, the carrier core material used in Patent Document 3 is steel beads, not ferrite particles (referring to the example). Further, the resin-coated carrier composed of two layers raises a problem of the interlayer exfoliation, and does not use a polyamideimide resin as a component of the coating resin.

Although various attempts using a resin-coated carrier have been performed in such manners, a resin-coated carrier has not been obtained which provides uniform coating, raises no problem of offensive odor, and exhibits various favorable properties in a long period when made into an electrophotographic developer.

On the other hand, Patent Document 4 (Japanese Patent Laid-Open No. 2002-148869) describes a coating resin layer of a resin-coated carrier which includes a fluororesin, a binder resin and silica particles having a particular specific surface area and a particular average particle size. It states that the silica particles prevent the spent by the toner against the carrier surface through the synergistic action with the fluororesin, and impart a favorable fluidity of the carrier.

However, even in this Patent Document 4, a resin-coated carrier, as in the case described above, has not been obtained which provides uniform coating, raises no problem of offensive odors, and exhibits various favorable properties in a long period when made into an electrophotographic developer.

Therefore, the present invention has on object to provide a resin-coated ferrite carrier having a uniform resin coating and emitting no offensive odors and the like, its production method, and an electrophotographic developer comprises the resin-coated ferrite carrier, is excellent in the charge stability and the image quality stability in a long period, causes less fogging of image or carrier adhesion, has a favorable image density and environmental dependability, and can fully respond to high-speed and full-color imaging.

SUMMARY OF THE INVENTION

As the result of the extensive studies by the present inventors, we have found that the above object can be achieved by coating the surface of ferrite particles (carrier core material) with a resin-containing aqueous solution obtained by dispersing a specific fluororesin and a silicon oxide in a resin solution in which a binder resin is dissolved in a water-based solvent, and thus achieved the present invention.

That is, the present invention provides a resin-coated ferrite carrier for an electrophotographic developer characterized in that the surfaces of ferrite particles are coated with a mixed resin of a tetrafluoroethylene-hexafluoropropylene copolymer or a tetrafluoroethylene-perfluoroalkylvinyl ether copolymer with a polyamideimide resin, and the mixed resin contains a silicon oxide.

In the resin-coated ferrite carrier according to the present invention, the mixing weight ratio of the tetrafluoroethylene-hexafluoropropylene copolymer or the tetrafluoroethylene-perfluoroalkylvinyl ether copolymer to a polyamideimide resin in the mixed resin is preferably 9:1 to 6:4.

In the resin-coated ferrite carrier according to the present invention, the above silicon oxide is preferably contained in an amount of 0.1 to 5 wt. % in the mixed resin.

In the resin-coated ferrite carrier according to the present invention, the above mixed resin is coated preferably in an amount of 0.01 to 10 wt. % based on the ferrite particles.

The present invention also provides a production method of a resin-coated ferrite carrier for an electrophotographic developer characterized in that a resin-containing aqueous solution prepared by dissolving a tetrafluoroethylene-hexafluoropropylene copolymer or a tetrafluoroethylene-perfluoroalkylvinyl ether copolymer and a silicon oxide in a resin solution containing a polyamideimide resin dissolved in an aqueous solvent, and the surface of ferrite particles is coated with the above resin by using the aqueous solution.

The present invention also provides an electrophotographic developer composed of the above resin-coated ferrite carrier and a toner.

A method for producing a resin-coated ferrite carrier according to the present invention provides a uniform resin coating on the surface of carrier particles, and raises no problems of offensive odors and the like caused by an organic solvent because a water-based solvent is used. An electrophotographic developer using a resin-coated ferrite carrier according to the present invention is excellent in the charge stability and the image quality stability in a long period, has little fog and carrier adhesion, and has a favorable image density and environmental dependability.

DETAILED DESCRIPTION OF THE PREFERRED EMBODIMENTS

Hereinafter, the best embodiments to practice the present invention will be illustrated.

<A Resin-Coated Ferrite Carrier According to the Present Invention>

A resin-coated ferrite carrier according to the present invention is one in which the surface of ferrite particles (carrier core material) is coated with a mixed resin of a tetrafluoroethylene-hexafluoropropylene copolymer or a tetrafluoroethylene-perfluoroalkylvinyl ether copolymer with a polyamideimide resin.

The composition of the ferrite particles (carrier core material) used in the present invention is not especially limited, but preferably one expressed by the following formula (1).

$$(MnO)x(MgO)y(Fe_2O_3)z \quad (1)$$

(wherein, x+y+z=100 mol %; x=35 to 45 mol %; y=5 to 15 mol %; and z=40 to 55 mol %)

For (MnO) and/or a part of (MgO) in the above formula (1), at least one of oxides selected from SrO, $Li_2O$, CaO, TiO, CuO, ZnO, NiO, $Bi_2O_3$ and $ZrO_2$ may be substituted.

Since the ferrite particles of such specific composition have a high magnetization and the excellent homogeneity of magnetization (little variations in magnetization), they are favorably used in the present invention.

A tetrafluoroethylene-hexafluoropropylene copolymer (hereinafter, may be referring to as FEP) used in the present invention is a fluorine-based resin having a melting point of 250 to 270° C. A tetrafluoroethylene-perfluoroalkylvinyl ether copolymer (hereinafter, maybe referring to as PFA) used in the present invention is a fluorine-based resin having a melting point of 300 to 310° C.

A polyamideimide resin used in the present invention is used as the binder resin, and is not especially limited in the production method, properties, etc., but is typically a copolymer of trimellitic anhydride and an organic bisamine, for example, 4,4'-diaminodiphenylmethane. The average molecular weight of such a copolymer is typically 15,000 to 30,000, preferably 20,000 to 25,000. Alternatively, a copolymer of pyromellitic anhydride and a bisamine, especially an aromatic bisamine can be used. Use of such polyamideimide resin as the binder resin imparts a high chargeability, a stability against in-machine environmental changes and a favorable spent resistance.

The mixing weight ratio of the tetrafluoroethylene-hexafluoropropylene copolymer (FEP) or the tetrafluoroethylene-perfluoroalkylvinyl ether copolymer (PFA) to the polyamideimide resin in the above mixed resin is preferably 9:1 to 6:4, more preferably 8:2 to 6:4. When the mixing amount of FEP or PFA is less than the above range in the mixing weight ratio of FEP or PFA and the polyamideimide resin, the spent resistance and the charge stability deteriorate, and when the mixing amount exceeds the above range, the durability decreases.

In a resin-coated ferrite carrier according to the present invention, a silicon oxide is contained in the mixed resin. With a silicon oxide contained in a mixed resin, a uniform resin coating can be obtained, and the adhesiveness with core particles is improved. The content of the silicon oxide is preferably 0.1 to 5 wt. % in the mixed resin. With the silicon oxide content of less than 0.1 wt. %, the effect of the content disappears, and with that exceeding 5 wt. %, the durability decreases.

The mixed resin is coated preferably in an amount of 0.01 to 10 wt. % based on the ferrite particles (carrier core material), further preferably 0.3 to 7 wt. %, and most preferably 0.5 to 5 wt. %. With the coating amount of less than 0.01 wt. %, the formation of a uniform coating layer on the carrier surface becomes difficult. With that exceeding 10 wt. %, the cohesion of the carriers are generated, thereby decreasing the productivity such as the yield and also causing the variations in the developer properties such as fluidity and charge quantity in actual machines.

A resin-coated ferrite carrier according to the present invention is desirably spherical, and the average particle size is preferably 20 to 100 μm, more preferably 30 to 70 μm. With the average particle size of less than 20 μm, the carrier adhesion is apt to occur, and white spots are caused. With that exceeding 100 μm, the image quality becomes coarse, and the desired definition becomes hard to obtain.

Further, in the above coating resin, a silane coupling agent can be contained as a charge controlling agent. The kind of a usable coupling agent is not especially limited, but is preferably an aminosilane coupling agent in the case of negative polarity toner, and a fluorine-based silane coupling agent in the case of positive polarity toner.

Further, in the above coating resin, conductive microparticles can be charged. The microparticles include conductive carbon, an oxide such as titanium oxide and tin oxide, and various kinds of organic conductive agents.

<A Method for Producing a Ferrite Carrier for a Developer According to the Present Invention>

Next, a method for producing a resin-coated ferrite carrier according to the present invention will be illustrated.

First, a ferrite raw material is weighed appropriately to a predetermined composition, and then pulverized and mixed by a ball mill, a vibrating mill or the like for at least 0.5 h, preferably for 1 to 20 h. The pulverized material thus obtained is pelletized by a press or the like, and thereafter calcined at a temperature of 700 to 1,200° C. Instead of using a press, after pulverization, the product may be charged with water to make a slurry, and granulated by using a spray drier. When the apparent density is desired to be kept low, the calcination step can be omitted.

After the calcination, it is further pulverized by a ball mill, a vibrating mill or the like, and there after the resulting pulverized material is charged with water, and optionally a dispersant, a binder and the like, granulated after the viscosity adjustment, and kept at a temperature of 1,000 to 1,500° C. for 1 to 24 h with the oxygen concentration controlled and sintered. When pulverized after the calcination, it may be charged with water and pulverized by a wet ball mill, a wet vibrating mill or the like.

The sinter obtained in such a manner is pulverized and classified. The classifying method involves adjusting the particle size to a desired one by using the existing air classification, mesh filtration, precipitation method or the like.

Thereafter, the classified particles may optionally undergo oxide coating by heating their surfaces to a low temperature to adjust electric resistance. The oxide coating requires a common type of electric furnace such as a rotary electric furnace and a batch-type electric furnace, and the heat treatment is conducted at a temperature of 300 to 700° C., for example. The thickness of the oxide coating formed by this treatment is preferably 0.1 nm to 5 μm. If the thickness is less than 0.1 nm, the effect of the oxide coating layer is little. If that exceeds 5 μm, since the magnetization decreases, and the resistance becomes too high, disadvantages such as the decrease in developing capacity are apt to take place. The reduction may be optionally conducted prior to oxide coating.

Next, on the surface of the above ferrite particles (carrier core material), a mixed resin (coating resin) containing a polyamideimide resin is coated. In the production method according to the present invention, a resin-containing aqueous solution is prepared by dispersing the FEP or PFA and silicon oxide, described above, in a resin solution in which the polyamideimide resin is dissolved in a water-based solvent, and the above mixed resin is coated on the surface of the above ferrite particles by using the aqueous solution. When a fluorinated epoxy resin is used as a resin to coat the surface of the ferrite particles, it is necessary for the solvent to contain an organic solvent strong in odor intensity such as methyl isobutyl ketone, which has raised problems of offensive odors, etc. in their production. By contrast, since a water-based solvent can be used because the mixed resin used in the present invention is soluble in water, the problems above do not arise. When an electrophotographic developer is manufactured, various properties are also improved.

Known coating methods may be used, for example, brush coating, fluidized bed spray drying, rotary drying, and immersion/drying using a universal stirrer. The fluidized bed process is more preferable due to a higher coverage of coating.

In the case where the resin is cured after coated on the carrier core material, an externally heating system and an internally heating system both can be used for curing. For example, a fixed-type or flow-type electric furnace, a rotary electric furnace, a burner furnace or the microwave can be used for curing.

<An Electrophotographic Developer According to the Present Invention>

An electrophotographic developer according to the present invention will be illustrated.

An electrophotographic developer according to the present invention is composed of the resin-coated ferrite carrier described above and a toner.

Toner particles constituting a developer according to the present invention come in pulverized toner particles manufactured by the pulverizing method and polymerized toner particles manufactured by the polymerization method. The toner particles by both methods can be used in the present invention.

Pulverized toner particles can be obtained by fully mixing, for example, a binding resin, a charge controlling agent, and a colorant by a Henschel mixer or the like, then melting and kneading by a biaxial extruder or the like, and after cooling, pulverizing, classifying, and after adding an additive, mixing by a mixer or the like.

The binding resin constituting pulverized toner particles is not especially limited, but includes a polystyrene, chloropolystyrene, styrene-chlorostyrene copolymer, styrene-acrylate copolymer, styrene-methacrylate copolymer, further a rosin-modified maleic acid resin, epoxy resin, polyester resin and polyurethane resin. These are used alone or by mixing.

Any charge controlling agent can be used. The agent for a positively chargeable toner includes, for example, a nigrosine dye, a quaternary ammonium salt, etc. The one for a negatively chargeable toner includes a metal-containing monoazo dye, etc.

As the colorant (coloring agent), conventionally known dyes and pigments are usable. For example, carbon black, phthalocyanine blue, permanent red, chrome yellow, phthalocyanine green, etc. can be used. Additionally, an additive such as silica powder and titania to improve the fluidity and cohesion resistance of a toner can be charged corresponding to the toner particles.

The polymerized toner particles come in toner particles manufactured by conventional methods such as the suspension polymerization method, emulsion polymerization method, emulsion coagulation method, ester elongation polymerization method and emulsion phase inversion method. Such toner particles by the polymerization method are obtained, for example, by mixing and agitating a colored dispersion liquid in which a colorant is dispersed in water using a surfactant, a polymerizable monomer, a surfactant and a polymerization initiator in an aqueous medium, emulsifying and dispersing the polymerizable monomer in the aqueous medium, polymerizing while agitating and mixing, adding a salting agent and salting out the polymerized particles, and filtrating, washing and drying the particles obtained by the salting-out. Thereafter, the dried toner particles are optionally charged with an additive.

Further, on production the polymerized toner particles, a fixation improving agent and a charge controlling agent can be blended other than the polymerizable monomer, surfactant, polymerization initiator and colorant, thus allowing to control and improve various properties of the polymerized toner particles obtained using these. Besides, for improving the dispersibility of the polymerizable monomer in the aqueous medium, and adjusting the molecular weight of the obtained polymer, a chain-transfer agent can be used.

The polymerizable monomer used for the manufacture of the above polymerized toner particles is not especially limited, but includes, for example, styrene and its derivative, ethylenic unsaturated monoolefins such as ethylene, propylene, halogenated vinyls such as vinyl chloride, vinylesters such as vinyl acetate, and α-methylene aliphatic monocarboxylate such as methyl acrylate, ethyl acrylate, methyl methacrylate, ethyl methacrylate, 2-ethylhexyl methacrylate, acrylic acid dimethylamino ester and methacrylic acid diethylamino ester.

As the colorant (coloring material) used for preparing the above polymerized toner particles, conventionally known dyes and pigments are usable. For example, carbon black, phthalocyanine blue, permanent red, chrome yellow and phthalocyanine green can be used. These colorants may be improved in the surface thereof by using a silane coupling agent, a titanium coupling agent and the like.

As the surfactant used for production the above polymerized toner particles, an anionic surfactant, a cationic surfactant, an amphoteric surfactant and a nonionic surfactant can be used.

Here, the anionic surfactants include sodium oleate, a fatty acid salt such as castor oil, an alkylsulfate such as sodium laurylsulfate and ammonium laurylsulfate, alkylbenzene sulfonate salts such as sodium dodecylbenzene sulfonate, an alkylnaphthalene sulfonate salt, an alkylphosphate salt, a naphthalene sulfonic acid-formalin condensate, a polyoxyethylene alkylsulfate salt, etc. The nonionic surfactants include a polyoxyethylene alkyl ether, a polyoxyethylene aliphatic acid ester, a sorbitan aliphatic acid ester, a polyoxyethylene alkyl amine, glycerin, an aliphatic acid ester, an oxyethylene-oxypropylene block polymer, etc. Further, the cationic surfactants include alkylamine salts such as laurylamine acetate, and quaternary ammonium salts such as lauryltrimethylammonium chloride, stearyltrimethylammonium chloride, etc. Then, the amphoteric surfactants include an aminocarbonate salt, an alkylamino acid, etc.

A surfactant as above is generally used in an amount within the range of 0.01 to 10 wt. % to a polymerizable monomer. Since the use amount of such a surfactant affects the dispersion stability of a monomer, and affects the environmental dependability of the obtained polymerized toner particles, it is preferably used in the amount within the above range where the dispersion stability of the monomer is secured, and the polymerized toner particles do not excessively affect the environmental dependability.

For production polymerized toner particles, a polymerization initiator is generally used. The polymerization initiators come in a water-soluble polymerization initiator and an oil-soluble polymerization initiator, and both of them can be used in the present invention. The water-soluble polymerization initiator used in the present invention includes, for example, a peroxosulfate salt such as potassium peroxosulfate, and ammonium peroxosulfate, and a water-soluble peroxide compound. The oil-soluble polymerization initiator includes, for example, an azo compound such as azobisisobutyronitrile, and an oil-soluble peroxide compound.

In the case where a chain-transfer agent is used in the present invention, the chain-transfer agent includes, for example, mercaptans such as octylmercaptan, dodecylmercaptan, and tert-dodecylmercaptan, carbon tetrabromide, etc.

Further, in the case where polymerized toner particles used in the present invention contain a fixation improving agent, as the fixation improving agent, a natural wax such as a carnauba wax, and an olefinic wax such as a polypropylene and a polyethylene can be used.

In the case where polymerized toner particles used in the present invention contain a charge controlling agent, the charge controlling agent to be used is not especially limited, and a nigrosine dye, quaternary an ammonium salt, an organic metal complex, a metal-containing monoazo dye and the like can be used.

The additive used for improving the fluidity etc. of polymerized toner particles includes silica, titanium oxide, barium titanate, fluororein microparticles, acrylic acid resin microparticles, etc., and these can be used alone or in combination thereof.

Further, the salting-out agent used for separating polymerized particles from an aqueous medium includes metal salts such as magnesium sulfate, aluminum sulfate, barium chloride, magnesium chloride, calcium chloride and sodium chloride.

The average particle size of the toner particles manufactured as above is in the range of 2 to 15 μm, preferably in the range of 3 to 10 μm. The polymerized toner particles have the higher uniformity than the pulverized toner particles. The toner particles of less than 2 μm decrease the charging capacity and are apt to bring about fog and toner scattering. Those exceeding 15 μm cause the degradation of image quality.

By mixing the carrier and the toner manufactured as above, an electrophotographic developer is obtained. The mixing ratio of the carrier to the toner, namely, the toner concentration, is preferably set to be 3 to 15%. With less than 3%, a desired image density is hard to obtain. With more than 15%, the toner scattering and fog are apt to occur.

The developer prepared as above can be used in copying machines, printers, FAXs, printing presses and the like, in the digital system, which use the development system in which electrostatic latent images formed on a latent image holder having an organic photoconductor layer are reversal developed by magnetic brushes of the two-component developer having the toner and the carrier while impressing a bias electric field. It is also applicable to full-color machines and the like which use an alternating electric field, which is a method to superimpose an AC bias on a DC bias, when the developing bias is applied from magnetic brushes to electrostatic latent image side.

Hereinafter, the present invention will be specifically illustrated by way of examples.

EXAMPLE 1

Carrier Production Example 1

Raw materials of 39.7 mol % in terms of MnO, 9.9 mol % in terms of MgO, 49.6 mol % in terms of $Fe_2O_3$ and 0.8 mol % in terms of SrO were blended in proper amount, charged with water, and pulverized, mixed and dried in a wet ball mill for 10 h, kept at 950° C. for 4 h, and then pulverized in a wet ball mill for 24 h to obtain a slurry. Then the slurry were granulated and spray-dried, kept at 1,270° C. for 6 h in an atmosphere of an oxygen concentration of 2%, and then crushed and adjusted for particle size to obtain manganese-based ferrite particles (carrier core material). The manganese ferrite particles had an average particle size of 35 μm and a saturation magnetization of 70 $Am^2/kg$ at an applied magnetic field of 3,000 ($10^3/4\pi \cdot A/m$).

Then, a polyamidoimido resin (a copolymer of trimellitic acid anhydride and 4,4'-diaminodiphenylmethane) was diluted with water to prepare a resin solution, in which a tetrafluoroethylene-hexafluoropropylene copolymer (FEP) was then dispersed, and a silicon oxide (2 wt. % of the total resin amount) was further dispersed to obtain a coating layer forming solution of 150 g in terms of solid content. The solid content ratio of the resin solution was 10 wt. %. The weight composition ratio of the polyamideimide resin to the FEP was 2/8. The coating layer forming solution and 10 kg of the ferrite particles described above were together charged in a fluidized-bed coater to perform coating. Thereafter, it was cured at 250° C. for 1 h to manufacture a resin-coated ferrite carrier 1 having a coated resin amount of 1.5 wt. %.

Developer Production Example 1

A developer "A" having a toner concentration of 6 wt. % was prepared using the above carrier 1 and a toner 1 (KM-C2630 toner, manufactured by Kyocera Mita Corp., color: magenta, composition: polyester, production method: pulverizing method). The image evaluation at an early stage and after 100,000 times was conducted by a KM-C2630 (manufactured by Kyocera Mita Corp.) as an evaluation instrument. The image evaluation at an early stage was conducted for the charge quantity, toner concentration, image density, fog, image quality and carrier adhesion; the image evaluation after 100,000 times was conducted for the charge quantity, toner concentration, image density, fog, image quality, environmental dependency and carrier adhesion. The results are shown in Table 1. The evaluation methods were as follows.

(Charge Quantity)

The charge quantities were measured by a Q/M meter, manufactured by Epping GmbH.

(Image Density)

The developments were conducted under an optimum exposure condition. The image densities of the solid part were measured by an X-Rite938, manufactured by Nippon Lithograph Inc., and ranked. The target value of the image density is at least 1.25.

(Fog)

The fogs were measured by a color-difference meter Z-300A, manufactured by Nippon Denshoku Kogyo KK. The target value of the fog is at most 5.

(Image Quality)

The developments were conducted under an optimum exposure, and the image qualities were visually judged, and evaluated on the following standard.

G: good

M: no problem in the practical use

P: not usable (Carrier Adhesion)

The developments were conducted under an optimum exposure condition, and the levels of carrier adhesion on images and white spots were visually judged, and evaluated on the following standard.

G: good

M: no problem in the practical use

P: not usable (Environmental Dependability)

The developments were conducted under L/L and H/H environments and under an optimum exposure, and the image qualities were visually judged, and evaluated on the following standard.

G: good

M: no problem in the practical use

P: not usable

EXAMPLE 2

Carrier Production Example 2

Ferrite particles were manufactured by the method as in Example 1. A mixed resin was coated on the surface of the carrier particles to manufacture a resin-coated ferrite carrier 2 having a coated resin amount of 1.5 wt. % as in Example 1, but using a tetrafluoroethylene-perfluoroalkylvinyl ether copolymer (PFA) instead of FEP as the fluororesin.

Developer Production Example 2

A developer B having a toner concentration of 6 wt. % was prepared using the above carrier 2 and the same toner 1 as used in Example 1. The image evaluations at an early stage and after 100,000 times were conducted as in Example 1. The results are shown in Table 1.

EXAMPLE 3

Carrier Production Example 3

Ferrite particles were manufactured by the method as in Example 1. A mixed resin was coated on the surface of the carrier particles to manufacture a resin-coated ferrite carrier 3 having a coated resin amount of 1.5 wt. % as in Example 1, but with the mixing weight ratio of the polyamideimide resin to the tetrafluoroethylene-hexafluoropropylene copolymer (FEP) being changed to 4/6.

Developer Production Example 3

A developer C having a toner concentration of 6 wt. % was prepared using the above carrier 3 and the same toner 1 as used in Example 1. The image evaluations at an early stage and after 100,000 times were conducted as in Example 1. The results are shown in Table 1.

EXAMPLE 4

Carrier Production Example 4

Ferrite particles were manufactured by the method as in Example 1. A mixed resin was coated on the surface of the carrier particles to manufacture a resin-coated ferrite carrier 4 having a coated resin amount of 1.5 wt. % as in Example 1, but using methyl ethyl ketone instead of water as the solvent.

Developer Production Example 4

A developer D having a toner concentration of 6 wt. % was prepared using the above carrier 4 and the same toner 1 as used in Example 1. The image evaluations at an early stage and after 100,000 times were conducted as in Example 1. The results are shown in Table 1.

EXAMPLE 5

Carrier Production Example 5

Ferrite particles were manufactured by the method as in Example 1. A mixed resin was coated on the surface of the carrier particles to manufacture a resin-coated ferrite carrier 5 having a coated resin amount of 1.5 wt. % as in Example 1, but with the mixing weight ratio of the polyamideimide resin to the tetrafluoroethylene-hexafluoropropylene copolymer (FEP) being changed to 6/4.

Developer Production Example 5

A developer E having a toner concentration of 6 wt. % was prepared using the above carrier 5 and the same toner 1 as used in Example 1. The image evaluations at an early stage and after 100,000 times were conducted as in Example 1. The results are shown in Table 1.

EXAMPLE 6

Carrier Production Example 6

Ferrite particles were manufactured by the method as in Example 1. A mixed resin was coated on the surface of the carrier particles to manufacture a resin-coated ferrite carrier 6 having a coated resin amount of 1.5 wt. % as in Example 1, but with the silicon oxide content being changed to 6 wt. % of the total resin.

Developer Production Example 6

A developer F having a toner concentration of 6 wt. % was prepared using the above carrier 6 and the same toner 1 as used in Example 1. The image evaluations at an early stage and after 100,000 times were conducted as in Example 1. The results are shown in Table 1.

COMPARATIVE EXAMPLE

Comparative Example 1

Carrier Production Comparative Example 7

Ferrite particles were manufactured by the method as in Example 1. A mixed resin was coated on the surface of the carrier particles to manufacture a resin-coated ferrite carrier 7 having a coated resin amount of 1.5 wt. % as in Example 1, but using tetrafluoroethylene resin (PTFE) instead of FEP as the fluororesin.

Developer Production Comparative Example 7

A developer G having a toner concentration of 6 wt. % was prepared using the above carrier 7 and the same toner 1 as used in Example 1. The image evaluations at an early stage and after 100,000 times were conducted as in Example 1. The results are shown in Table 1.

Comparative Example 2

Carrier Production Comparative Example 8

Ferrite particles were manufactured by the method as in Example 1. A mixed resin was coated on the surface of the carrier particles to manufacture a resin-coated ferrite carrier 8 having a coated resin amount of 1.5 wt. % as in Example 1, but using an epoxy resin instead of the polyamideimide resin as the binder resin.

Developer Production Comparative Example 8

A developer H having a toner concentration of 6 wt. % was prepared using the above carrier 8 and the same toner 1 as used in Example 1. The image evaluations at an early stage and after 100,000 times were conducted as in Example 1. The results are shown in Table 1.

Comparative Example 3

Carrier Production Comparative Example 9

A carrier core material was manufactured by mixing the ferrite particles manufactured by the method as in Example 1 with a flat iron powder (mixing weight ratio 40/60).

Then, the mixed resin was coated on the surface of the carrier core material to manufacture a resin-coated ferrite carrier 9 having a coated resin amount of 1.5 wt. % as in Example 1.

Developer Production Comparative Example 9

A developer I having a toner concentration of 6 wt. % was prepared using the above carrier 9 and the same toner 1 as used in Example 1. The image evaluations at an early stage and after 100,000 times were conducted as in Example 1. The results are shown in Table 1.

Comparative Example 4

Carrier Production Comparative Example 10

A carrier core material was manufactured by mixing the ferrite particles manufactured by the method as in Example 1 with a spherical magnetite (mixing weight ratio 20/80).

Then, the mixed resin was coated on the surface of the carrier core material to manufacture a resin-coated ferrite carrier 10 having a coated resin amount of 1.5 wt. % as in Example 1.

Developer Production Comparative Example 10

A developer J having a toner concentration of 6 wt. % was prepared using the above carrier 10 and the same toner 1 as used in Example 1. The image evaluations at an early stage and after 100,000 times were conducted as in Example 1. The results are shown in Table 1.

TABLE 1

| | | | At an early stage | | | | | | After 100,000 times | | | | | | |
|---|---|---|---|---|---|---|---|---|---|---|---|---|---|---|---|
| | Developer | Carrier | Charge quantity | Toner concentration | Image density | Fog | Image quality | Carrier adhesion | Charge quantity | Toner concentration | Image density | Fog | Image quality | Environmental dependability | Carrier adhesion |
| Example 1 | A | Carrier 1 | 22.5 | 5.8 | 1.49 | 0 | G | G | 20.8 | 5.6 | 1.47 | 1 | G | G | G |
| Example 2 | B | Carrier 2 | 20.3 | 5.7 | 1.43 | 0 | G | G | 18.7 | 5.4 | 1.45 | 1 | G | G | G |
| Example 3 | C | Carrier 3 | 18.4 | 5.7 | 1.45 | 0 | G | G | 17.5 | 5.40 | 1.43 | 1 | G | G | G |
| Example 4 | D | Carrier 4 | 17.8 | 5.6 | 1.45 | 1 | G | G | 16.3 | 5.50 | 1.45 | 2 | G | M | G |
| Example 5 | E | Carrier 5 | 16.7 | 5.6 | 1.52 | 1 | G | G | 12.0 | 5.7 | 1.59 | 5 | M | M | G |
| Example 6 | F | Carrier 6 | 18.6 | 5.7 | 1.44 | 0 | G | G | 12.5 | 6.20 | 1.59 | 5 | M | M | M |
| Comparative Example 1 | G | Carrier 7 | 20.3 | 5.7 | 1.48 | 2 | G | G | 9.2 | 6.5 | 1.62 | 5 | M | M | M |
| Comparative Example 2 | H | Carrier 8 | 12.2 | 5.7 | 1.55 | 2 | M | G | 6.7 | 6.4 | 1.64 | 8 | M | P | P |
| Comparative Example 3 | I | Carrier 9 | 15.8 | 5.5 | 1.56 | 2 | M | G | 8.5 | 4.9 | 1.6 | 7 | P | P | G |
| Comparative Example 4 | J | Carrier 10 | 19.0 | 5.7 | 1.5 | 2 | M | G | 10.1 | 5 | 1.6 | 6 | P | P | G |

As clarified from the results in Table 1, Examples 1 to 6 maintain high charge quantities with elapsed times, and are favorable in the fog, image quality, environmental dependability and carrier adhesion. In particular, Examples 1 to 3, where the production method according to the present invention is used, and the mixing weight ratio of the polyamideimide resin to the tetrafluoroethylene-hexafluoropropylene copolymer (FEP) is in a certain range, and the content of the silicon oxide is in a specific range, exhibit excellent properties. By contrast, Comparative Examples 1 to 4 exhibit the decrease in charge quantities with elapsed times, and are inferior in the fog, image quality, environmental dependency, etc.

The production method of the resin-coated ferrite carrier according to the present invention provides a uniform resin coating on the surface of carrier particles, and raises no problems such as offensive odors, etc. caused by an organic solvent because a water-based solvent is used. The electrophotographic developer using the resin-coated ferrite carrier according to the present invention is excellent in the charge stability and image quality stability over a long period, further exhibits little fog and carrier adhesion, and is favorable in the image density and environmental dependency.

Therefore, the electrophotographic developer according to the present invention is used for copying machines, printers and the like, and can fully respond to the high-speed and full-color of developing machines.

What is claimed is:

1. A resin-coated ferrite carrier for an electrophotographic developer, wherein the surface of each ferrite particle is coated with a mixed resin of a tetrafluoroethylene-hexafluoropropylene copolymer or a tetrafluoroethylene-perfluoroalkylvinyl ether copolymer and a polyamideimide resin, wherein the mixing weight ratio of the tetrafluoroethylene-hexafluoropropylene copolymer or the tetrafluoroethylene-perfluoroalkylvinyl ether copolymer to the polyamideimide resin in the mixed resin is 9:1 to 6:4, and the mixed resin contains a silicon oxide.

2. The resin-coated ferrite carrier for an electrophotographic developer according to claim 1, wherein the silicon oxide is contained in an amount of 0.1 to 5 wt. % in the mixed resin.

3. The resin-coated ferrite carrier for an electrophotographic developer according to claims 1, wherein the mixed resin is coated in an amount of 0.01 to 10 wt. % based on the ferrite particle.

4. A method for producing a resin-coated ferrite carrier for an electrophotographic developer, comprising: preparing a resin solution containing a polyamideimide resin dissolved in an aqueous solvent; dispersing a tetrafluoroethylene-hexafluoropropylene copolymer or a tetrafluoroethylene-perfluoroalkylvinyl ether copolymer and a silicon oxide in the resin solution to prepare a mixed resin-containing aqueous solution; and coating the resins on the surface of each ferrite particle by using the aqueous solution, wherein the mixing weight ratio of the tetrafluoroethylene-hexafluoropropylene copolymer or the tetrafluoroethylene-perfluoroalkylvinyl ether copolymer to the polyamideimide resin in the mixed resin is 9:1 to 6:4.

5. An electrophotographic developer comprising the resin-coated ferrite carrier according to claim 1 and a toner.

* * * * *